US006158421A

United States Patent [19]

Hsieh et al.

[11] Patent Number: 6,158,421

[45] Date of Patent: Dec. 12, 2000

[54] GAS ECONOMIZER

[76] Inventors: Chin-San Hsieh, 3F, No.14, Alley 19, Lane 76, Hao-Tong Rd.; Yung-Li Hsiung, 7F, Lane 154, Hsiu-Wen Street, both of Kaohsiung City, Taiwan

[21] Appl. No.: 09/382,653

[22] Filed: Aug. 25, 1999

[51] Int. Cl.[7] ..... F02B 75/10

[52] U.S. Cl. ..... 123/538

[58] Field of Search ..... 123/538, 536, 123/537; 210/222, 695

[56] References Cited

U.S. PATENT DOCUMENTS

| | | | |
|---|---|---|---|
| 4,414,951 | 11/1983 | Saneto | 123/538 |
| 4,568,901 | 2/1986 | Adam | 210/222 |
| 5,024,271 | 6/1991 | Meihua | 210/222 |
| 5,161,512 | 11/1992 | Adam et al. | 123/538 |
| 5,816,226 | 10/1998 | Jernigan et al. | 123/538 |
| 5,992,398 | 11/1999 | Ho | 123/536 |

*Primary Examiner*—Marguerite McMahon
*Attorney, Agent, or Firm*—Dougherty & Troxell

[57] ABSTRACT

A gas economizer consists of an annular body formed with a plurality of magnetic member of a convex lens shape, fixed around a pipe so as to produce a strong magnetic field with magnetic force lines for activating gasoline passing through the pipe to a carburetor to permit gasoline to burn completely in an engine, and thus increasing power and prolonging the service life of the pipe.

5 Claims, 6 Drawing Sheets

GAS ECONOMIZER

BACKGROUND OF THE INVENTION

This invention relates to a gas economizer, particularly to one saving and activating gasoline, increasing power and effective to lessen pollution to the environment.

A known conventional gas economizer shown in FIGS. 1 and 2, includes an annular body 10 with a radial gap, and four magnets 11 fitted in the disc-shaped body 10 in spaced-apart condition. This annular body 10 with the four magnets 11 is fitted around a gas tube 12 to activate gasoline particles. FIG. 2 shows magnetic force lines 13 produced by the four magnets 11 and attract one another to interfere the magnetic force lines so that the magnetic force lines may be distributed unbalanced. Provided that a metal 14 passes through the center of the annular body 10, the metal 14 will be attracted to one of the four magnets 11, forcing the metal 14 biasing to one magnet 11, impossible to pass through the center of the annular body 10. And the magnetic force lines 13 attract one another and interfere them to result in their distribution unbalanced so gasoline passing through the gas economizer 1 may not be acivated sufficiently.

As understood from the aforementioned, magnetic force lines of the known conventional gas economizer are impossible to concentrate the magnetic fields and liable to attract and interfere with one another, and thus impossible to obtain anticipated effect in activating gasoline. Consequently, little-activated gasoline cannot burn completely, not that the conventional gas economizer economizes gasoline.

SUMMARY OF THE INVENTION

This invention has been devised to offer a gas economizer possible to enhance burning efficiency so as to lessen pollution to the environment and save gas.

The feature of the invention is an annular body composed of a plurality of magnetic members to produce strong well-balanced magnetic field fitted around a gas pipe to activate gasoline passing through the pipe fixed with the annular body, permitting gas to burn completely to increase power and the service life of the pipe.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
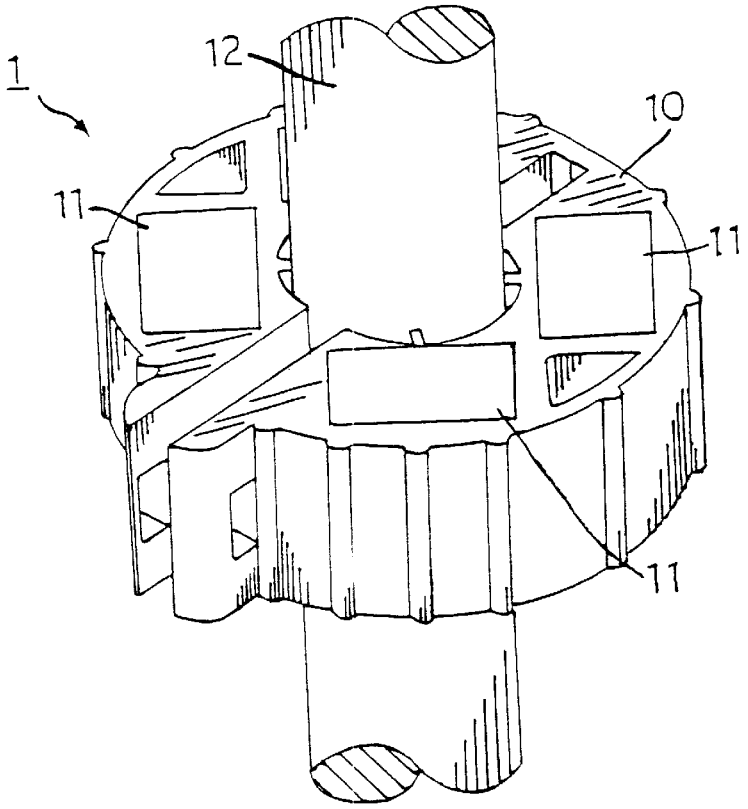
Fig. 1 Prior Art
FIG. 1 is a perspective view of a known conventional gas economizer.
Figure 2:
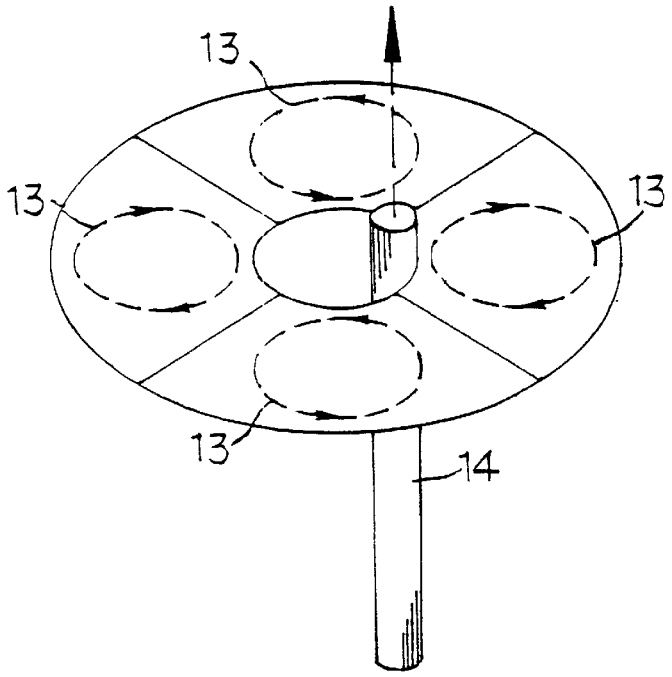
Fig. 2 Prior Art
FIG. 2 is a perspective view of distributed condition of magnetic force lines of the known conventional gas economizer.
Figure 3:
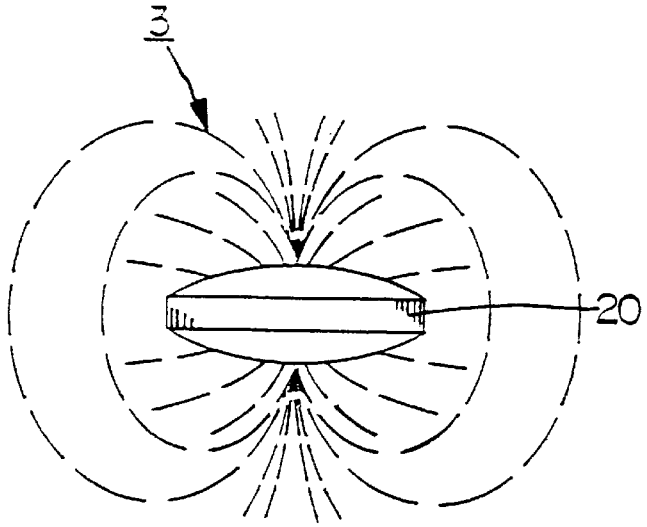
FIG. 3 is a side view of a magnetic member in a gas economizer in the present invention.
Figure 4:
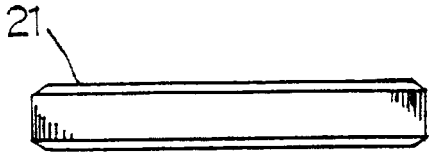
FIG. 4 is a side view of a magnet in the gas economizer in the present invention.
Figure 5:
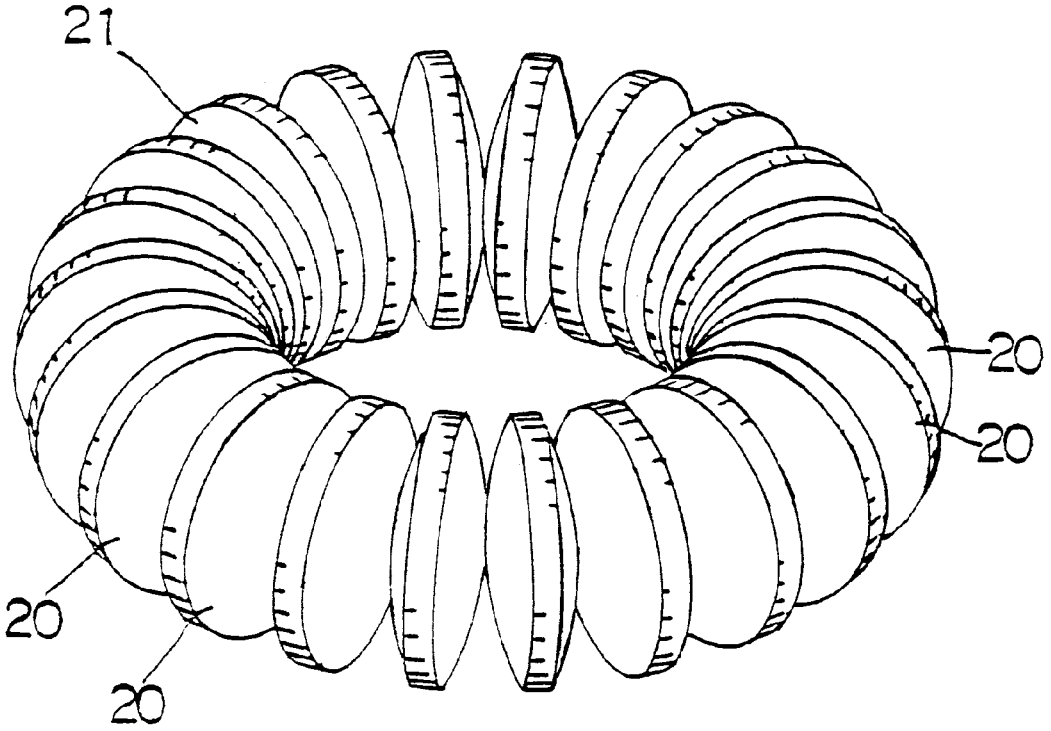
FIG. 5 is a perspective view of a first embodiment of the gas economizer in the present invention.

A first embodiment of a gas economizer in the present invention, as shown in FIGS. 3, 4 and 5, includes a plurality of magnetic members 20 and magnets 21 arranged to abut one another to form an annular body.

The magnetic members 20 respectively have a disc shape with two opposite sides swelled up to the center to look like a convex lens. After they are arranged into an annular body, they produce a strong magnetic field with magnetic force lines.

The magnets 21 is shaped as a disc of the same diameter as the magnetic members 20 and alternately connected with the magnetic members 20 in the annular body. Each magnet 21 has two opposite flat smooth sides, also producing magnetic field.

Figure 6:
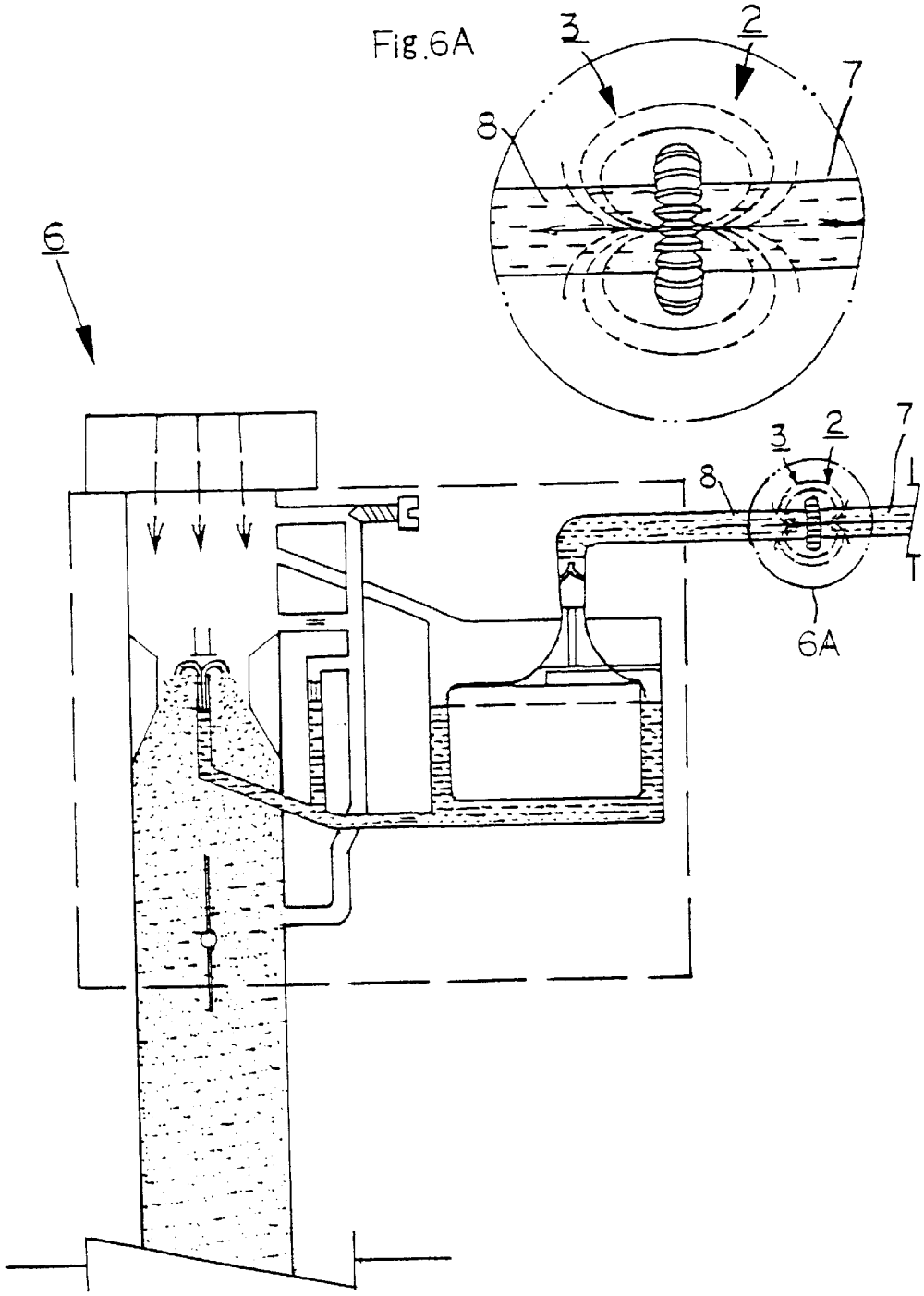
FIG. 6 is a side cross-sectional view of the first embodiment of a gas economizer fitted around a gas pipe leading to a carburetor in the present invention.

FIG. 6 shows that the gas economizer 2 of the annular body composed of the magnetic members 20 and the magnet 21 is fitted around a gas pipe 7 connected to a carburetor. Then the gas economizer 2 produces a strong magnetic field 3, with each of the convex magnetic members 20 may produce a magnetic field with magnetic force lines tending in various angles and directions. As gasoline has a feature both to counter and to comply to magnetism so that particles of gasoline may be activated to vibrate, and the annular gas economizer 2 fitted around the pipe 7 connected to the carburetor 6 produces a strong magnetic field with magnetic force lines extending in various directions and angles, because of the convex shape of the magnetic members 20. Then gasoline passing through the pipe 7 is activated to permit particles of gasoline produce activation and smoothness, and flow into the carburetor 6 which vaporizes the activated gasoline and shoots it into an engine to burn completely and explode therein. In this way the gas economizer can also enhance the service life of the pipe, and lessen pollution to the environment by complete combustion of gasoline.

The magnetic members 20 and the magnet 21 are made of magnetic ore, and permit the gas economizer provided with the advantage of magnet itself, the least friction and conductivity as little as an insulating material.

The magnetic members 20 and the magnet 21 can also be made of the material which is used to make superconductor so the gas economizer may have magnetism like superconductor to activate gasoline.

Provision of the gas economizer on the pipe route 7 connected to the front end of the carburetor 6 can enhance complete combustion of gasoline and explosion and after combustion toxic element contained in exhausted black waste gas is lowered, keeping the envornment clean.

Figure 7:
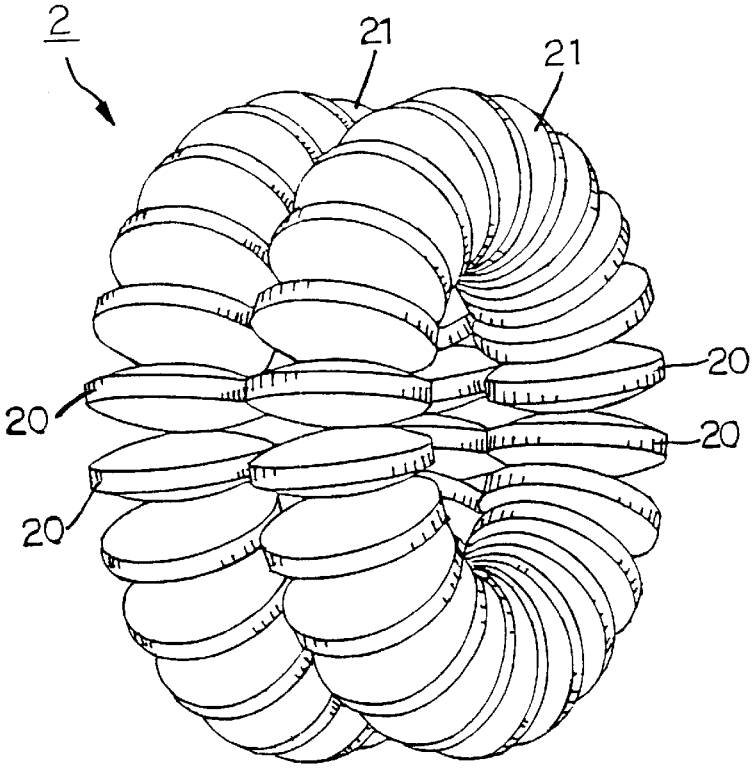
FIG. 7 is a perspective view of a second embodiment of a gas economizer in the present invention.

Next, FIG. 7 shows a second embodiment of a gas economizer in the invention, which is consisted of two annular bodies of the magnetic members 20 and magnets 21, strengthening effect of activation to gasoline. Each annular body is just like the gas economizer 2 in the first embodiment, consisting of a plurality of the magnetic members 20 and one or more magnets 21 abutting one another alternately in a ring shape, not easily separating from one another by means of mutual attraction between the magnetic members 20 and the magnet(s) 21.

Further, the magnetic members 20 and the magnets 21 are arranged to be alternately placed one another, permitting one flat surface of a magnet 21 contact one convex surface of a magnetic member 20 to increase connecting stability of the magnetic members 20 with the magnets 21.

Figure 8:
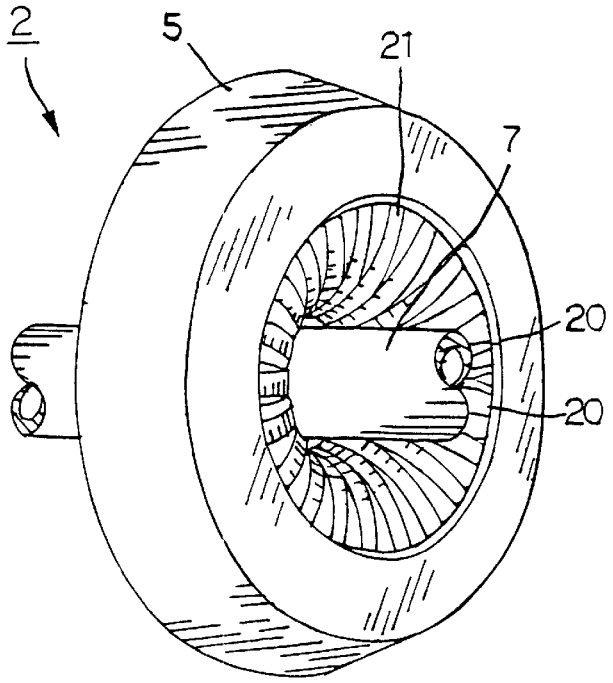
FIG. 8 is a perspective view of a housing containing the gas economizer in the present invention.
Figure 9:
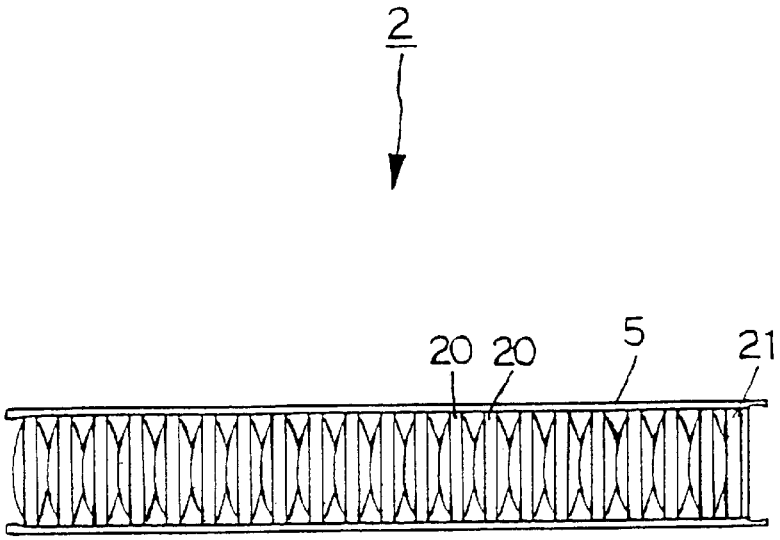
FIG. 9 is an upper view of the gas economizer in spread-out condition in the present invention; and, FIG. 10 is a side view of the gas economizer in spread-out condition in the present invention.
Figure 10:
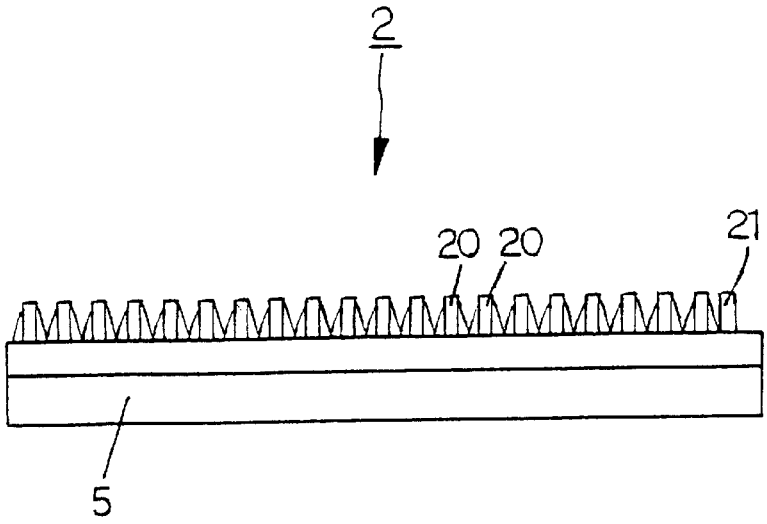

Further, FIG. 8 shows a housing 5 for keeping the gas economizer 2 therein or the magnetic members 20 and the magnets 21 are fitted in the housing 5. Then the magnetic members 20 and the magnets 21 are kept more stabilized therein than otherwise.

The housing 5 has a center hole for the pipe 7 to pass through and an outer closed circumference so that when the gas economizer 2 is placed in the housing 5, it may directly contact the pipe route 7 and activates sufficiently gasoline in the pipe 7.

Further, the housing 5 is flexible to permit the gas economizer 2 to be assembled in or disassembled from the housing 5 easily, quickly and properly tightly. The housing can be made of rubber or plastic having heat-enduring and heat-insulating feature so as to increase heat-resisting effect and cleanness of the gas economizer, and not permit metal or oil residue attach thereon to keep it clean and handy to wash.

The gas economizer in the invention has the following advantages.

1. Magnetic force lines are distributed well-balanced, as each magnetic member 20 is convex-shaped to produce a magnetic field with magnetic force lines extending in various angle and direction to form a wide and strong magnetic field together with the magnets 21, activating every minute gas particle, because magnetic lines in various directions can surely perform vibration to every gas particle instantly and quickly. And they can also have the same conspicuous effect to diesel oil.

2. It can enhance activation effect to gasoline. The wide and strong magnetic field 3 can permit activate gasoline burn completely, increasing power and prolonging the life service of the pipe route 7 by protecting the pipe 7, enhancing power and lowering pollution to the environment.

3. It is easy to manufacture and assemble. The magnetic members and the magnets are made separately and easily, and then they are connected to one another quickly and fitted in the housing 5 with convenience. The housing 5 is also easily fixed around the pipe 7.

4. It can enhance effect in protecting the environment. Gasoline passing through the pipe 7 and the gas economizer fixed thereon can be activated to burn completely in an engine with exhausted waste gas containing less toxic element.

While the preferred embodiments of the invention have been described above, it will be recognized and understood that various modifications may be made therein and the appended claims are intended to cover all such modifications which may fall within the spirit and scope of the invention.

What is claimed is:

1. A gas economizer comprising an annular body composed of a plurality of magnetic members connected to one another, each said magnetic member being of a disc shape with two swelled up side surfaces to look like a convex lens, said annular body easily fixed around a pipe connected to a carburetor of a car to produce a strong well-balanced magnetic field to activate gasoline passing through said pipe, thus activating gasoline to burn completely and enhance power and increase the service life of said pipe.

2. The gas economizer as claimed in claim 1, wherein said gas economizer is contained in a housing fixed on said pipe.

3. The gas economizer as claimed in claim 1, wherein said housing has a center hole for said pipe to pass through, and an outer closed circumference.

4. The gas economizer as claimed in claim 1, wherein said housing is made of rubber or plastic.

5. The gas economizer as claimed in claim 1, wherein said gas economizer is constituted of two said annular bodies to strengthen activating effect to gasoline.

* * * * *